US009222361B2

(12) United States Patent
Steinbauer et al.

(10) Patent No.: US 9,222,361 B2
(45) Date of Patent: Dec. 29, 2015

(54) ROTARY PISTON MACHINE HAVING SHAFT ENCODER

(71) Applicant: AVL List GmbH, Graz (AT)

(72) Inventors: Michael Steinbauer, Graz (AT); Andreas Krobath, Graz (AT)

(73) Assignee: AVL List GmbH, Graz (AT)

( * ) Notice: Subject to any disclaimer, the term of this patent is extended or adjusted under 35 U.S.C. 154(b) by 117 days.

(21) Appl. No.: 13/902,706

(22) Filed: May 24, 2013

(65) Prior Publication Data

US 2013/0259724 A1 Oct. 3, 2013

Related U.S. Application Data

(63) Continuation of application No. PCT/EP2011/005922, filed on Nov. 24, 2011.

(30) Foreign Application Priority Data

Nov. 25, 2010 (AT) ..... A 1965/2010

(51) Int. Cl.

| | |
|---|---|
| ***G01M 15/06*** | (2006.01) |
| ***F01C 20/06*** | (2006.01) |
| ***F01C 1/22*** | (2006.01) |

(52) U.S. Cl.

CPC . *F01C 20/06* (2013.01); *F01C 1/22* (2013.01); *F04C 2240/807* (2013.01); *F04C 2240/81* (2013.01)

(58) Field of Classification Search

CPC ..... F04C 2240/807; G01M 15/06

USPC ..... 73/114.03, 114.04, 114.26, 114.27

See application file for complete search history.

(56) References Cited

U.S. PATENT DOCUMENTS

| | | | | |
|---|---|---|---|---|
| 4,901,072 | A * | 2/1990 | Fox | 341/10 |
| 5,469,741 | A * | 11/1995 | Scourtes et al. | 73/462 |
| 5,806,014 | A * | 9/1998 | Remboski et al. | 701/111 |
| 6,313,625 | B1 * | 11/2001 | Varady et al. | 324/207.25 |
| 7,104,119 | B1 * | 9/2006 | Trapasso et al. | 73/114.26 |
| 7,362,018 | B1 * | 4/2008 | Kulogo et al. | 310/68 B |
| 2010/0107747 | A1 * | 5/2010 | Rolew et al. | 73/114.26 |
| 2011/0197703 | A1 * | 8/2011 | Badre-Alam et al. | 74/574.1 |
| 2013/0104635 | A1 * | 5/2013 | Hoetzel | 73/114.26 |

FOREIGN PATENT DOCUMENTS

| | | | |
|---|---|---|---|
| DE | 3509208 | A1 | 9/1985 |
| DE | 102008025185 | A1 | 11/2009 |
| WO | WO 2008054582 | A1 | 5/2008 |

OTHER PUBLICATIONS

International Search Report for PCT/EP2011/005922, Dated Mar. 25, 2013.

* cited by examiner

*Primary Examiner* — Eric S McCall

(74) *Attorney, Agent, or Firm* — Knobbe, Martens, Olson & Bear, LLP

(57) ABSTRACT

A rotary piston machine is disclosed. In one aspect, the machine includes a shaft and a shaft encoder including a first structure, based on which the rotational speed and/or the rotational position of the shaft can be determined by scanning the first structure with a sensor. The shaft encoder has a rotationally asymmetrical mass distribution in order to produce an imbalance.

21 Claims, 5 Drawing Sheets

ROTARY PISTON MACHINE HAVING SHAFT ENCODER

CROSS-REFERENCE TO RELATED APPLICATIONS

This application is a continuation application, and claims the benefit under 35 U.S.C. §§120 and 365 of PCT Application No. PCT/EP2011/005922, filed on Nov. 24, 2011, which is hereby incorporated by reference. PCT/EP2011/005922 also claimed priority from Austrian Patent Application No. A 1965/2010, filed on Nov. 25, 2010. All patent documents are incorporated in their entireties.

BACKGROUND

1. Field

The described technology generally relates to a rotary piston machine, especially a rotary engine.

2. Description of the Related Technology

In motor vehicles with an electric drive and a range extender, the internal combustion engine of the range extender is typically started and shut off while driving without any direct interaction by the driver, particularly in dependence on the state of charge of the battery of the electric drive. In contrast to motor vehicles that are driven by a mere internal combustion engine, the internal combustion engine of the range extender is not operated continuously in such motor vehicles, but rather only intermittently and typically has extended periods of inactivity.

When starting and shutting off the internal combustion engine of the range extender, it is important that the eccentric shaft and therefore the rotary piston have a defined rotational position in order to respectively achieve a reliable start and an advantageous stopping position. It may furthermore be desirable to measure the rotational speed and, if applicable, its fluctuations during the operation of the internal combustion engine.

For this purpose, the eccentric shaft is usually coupled to a shaft encoder, the circumferential region of which features a defined structure such as, for example, teeth and tooth spaces that can be detected by sensors during the rotation of the shaft encoder. This makes it possible to obtain information on the current rotational position and rotational speed of the shaft encoder or the shaft.

SUMMARY

One inventive aspect is a rotary piston machine with simplified design.

Another aspect is a rotary engine, in which an essentially triangular rotary piston revolves on an eccentric shaft arranged in a crankcase.

Another aspect is rotary engines with two, four or more piston corners that may be used in rotary piston machines with a rotary piston that centrally revolves in the crankcase.

Another aspect is rotary piston machines with two, three or more adjacently arranged rotary pistons.

Another aspect is motor vehicles, as well as in conjunction with a power generating unit, in particular, in the form of a so-called range extender in electrically operated motor vehicles.

Another aspect is rotary piston machine, for example, a rotary engine that includes a shaft and a shaft encoder with a first structure that can be scanned by means of a sensor in order to determine the rotational speed and/or rotational position of the shaft, wherein the shaft encoder has a rotationally asymmetrical mass distribution in order to produce an imbalance.

In some embodiments, the shaft encoder is provided for determining the rotational position and/or rotational speed of the shaft such that it has an imbalance, wherein said imbalance is sufficiently intense for at least partially replacing one or more balancing weights that are typically arranged on the shaft and serve for compensating the imbalance of the eccentric shaft.

A rotationally asymmetrical mass distribution refers to the mass of the shaft encoder not being distributed rotationally symmetrical about the rotational axis of the shaft encoder. In this case, the mass of the shaft encoder is distributed in such a way that only a rotation about the rotational axis by an angle of 360° causes the shaft encoder to be mapped onto itself, wherein this is not the case with rotations by any other angle.

The shaft encoder may comprise an encoder disk, on which the first structure is arranged, wherein the encoder disk has a rotationally asymmetrical mass distribution. In this case, the first structure is arranged, in particular, on the outer circumference of the encoder disk and essentially may have a rotationally symmetrical mass distribution. In this embodiment, the imbalance of the shaft encoder is essentially realized with the design of the encoder disk that contains the predominant portion of the mass of the shaft encoder, namely without thusly affecting the first structure and therefore the reliability in determining the rotational speed and/or the rotational position of the shaft encoder.

In another embodiment, the encoder disk includes at least one first sector that has a higher moment of inertia than a second sector of the encoder disk that corresponds to the first sector and lies opposite thereof. In at least one area of the first sector, the encoder disk has, in particular, a greater thickness and/or mass density than the corresponding region of the second sector. The region of the first sector may extend in the circumferential direction of the encoder disk. Due to these measures, a rotationally asymmetrical mass distribution, as well as the imbalance resulting thereof, can be realized in a simple and reliable fashion without unnecessarily increasing the overall mass of the shaft encoder.

The mass distribution of the shaft encoder may be realized in such a way that the imbalance resulting from a rotation of the shaft encoder reduces or compensates an imbalance of the rotating shaft. In this embodiment, one or more additional balancing weights that usually compensate an imbalance of the shaft, particularly the eccentric shaft, can be eliminated such that the design of the engine is further simplified.

In some embodiments, the first structure, by means of which the respective rotational position and/or rotational speed of the shaft or the shaft encoder can be determined when it is scanned by a sensor, has an at least partially periodic progression. This makes it possible to determine the respective rotational position or rotational speed of the shaft in a particularly simple fashion.

In another embodiment, the shaft encoder includes a second structure that may cooperate with a starter in order to set the shaft encoder in rotation. The second structure may be realized in the form of a gear rim or so-called ring gear that can be set in rotation by a gearwheel of the starter that also may form part of the rotary piston machine. Since the gear rim and the shaft encoder are integrated into a single component that can be mounted on the eccentric shaft, the assembly of the engine is simplified because the shaft encoder and the gear rim would otherwise have to be installed in separate steps. Furthermore, this also simplifies the design of the engine and increases its compactness.

The shaft encoder and the first and/or second structure may be realized in one piece. This not only simplifies the manufacture of the shaft encoder and the respective first or second structure, but also its installation on the shaft.

The shaft encoder including the first and/or second structure is manufactured, in particular, in the form of a casting such that the rotationally asymmetrical mass distribution or the gear rim can be respectively realized in a particularly simple and reliable fashion.

In an alternative embodiment, the second structure may be manufactured in the form of a separate component and pressed onto the shaft encoder. In this way, the technical peculiarities in the manufacture, in particular, of the gear rim can be taken into consideration without affecting the simplicity and compactness of the shaft encoder design.

The shaft encoder may be connected to the shaft in a rotationally rigid fashion. In one embodiment, the shaft consists, in particular, of an eccentric shaft. In this case, the rotationally asymmetrical mass distribution in the shaft encoder is utilized in a particularly advantageous fashion because imbalances during the rotation of the eccentric shaft are compensated or at least reduced in a simple and reliable fashion and the otherwise required balancing weights can be eliminated.

The rotary piston machine may comprise a sensor for scanning the first structure of the shaft encoder and an evaluation device for deriving the rotational speed and/or the rotational position of the shaft based on the scanned first structure of the shaft encoder.

DETAILED DESCRIPTION

Figure 1:
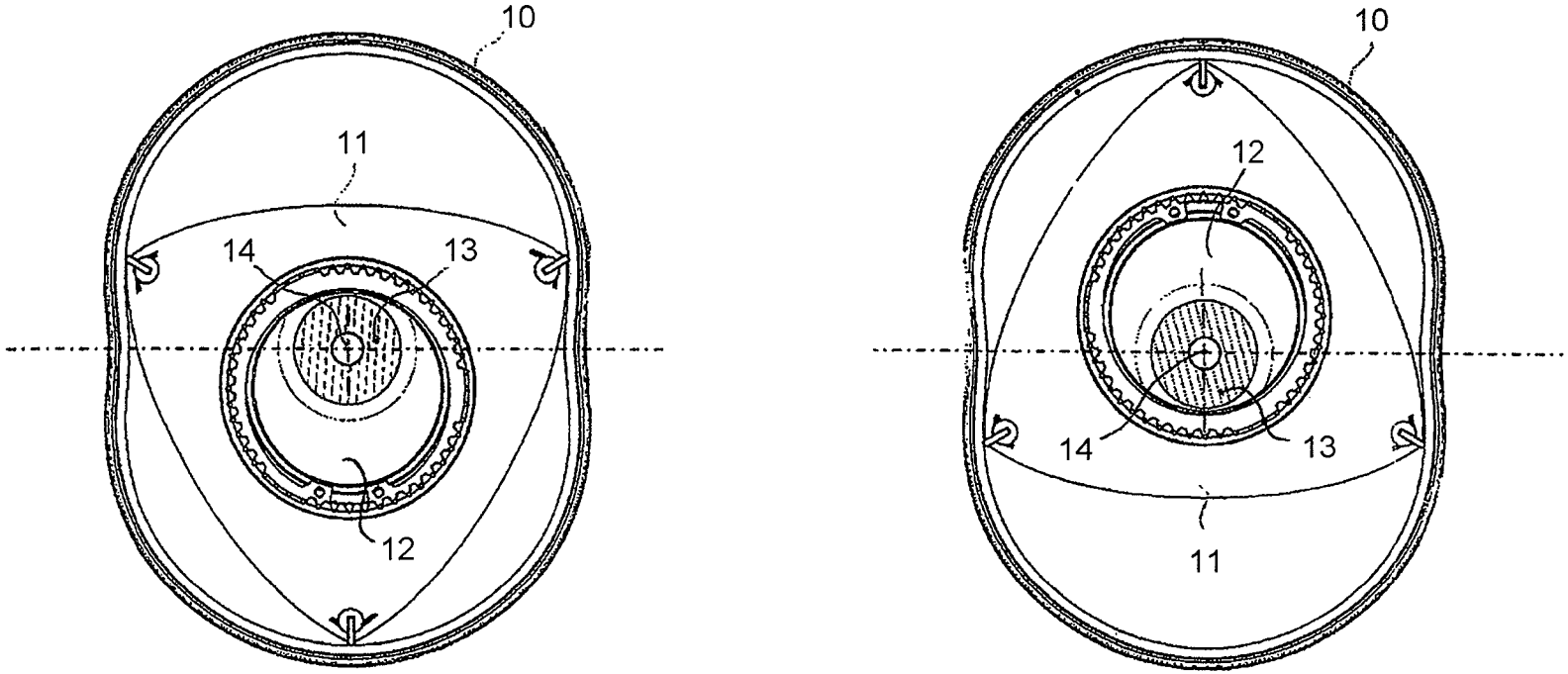
FIG. 1 shows a schematic cross section through a rotary engine in different piston positions.

FIG. 1 shows a cross section through a rotary engine in different piston positions. A rotary piston 11 in the form of a triangle that is composed of flattened circular arcs revolves on a disk cam 12 of an eccentric shaft 13 arranged in a crankcase 10 and sets this eccentric shaft in rotation. The position of the rotational axis 14 of the eccentric shaft 13 is stationary in this case.

A shaft encoder arranged on the eccentric shaft 13, particularly on the face thereof, is not illustrated in FIG. 1 in order to provide a better overview and described in greater detail below with reference to the example illustrated in FIG. 2.

Figure 2:
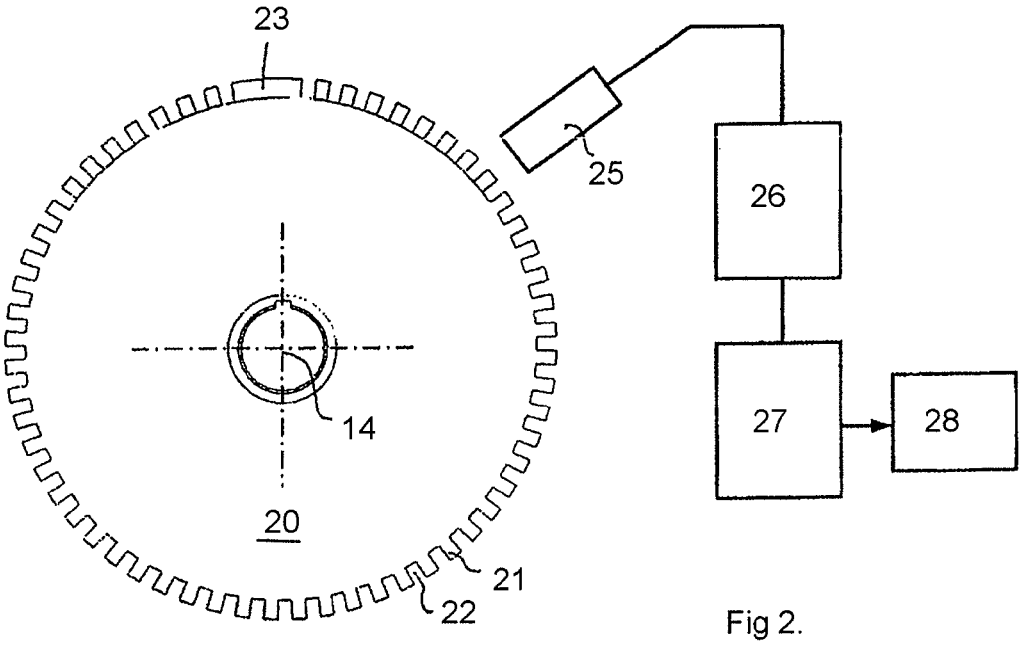
FIG. 2 shows an example of a shaft encoder in connection with devices for determining the rotational position and/or the rotational speed and for controlling the engine.

FIG. 2 shows an example of a shaft encoder 20 that in the region of its outer circumference features a structure or a pattern in the form of a plurality of teeth 21 and tooth spaces 22 with essentially identical width. One additional tooth 23 is provided in the example of a shaft encoder 20 illustrated in this figure, wherein the width of this additional tooth amounts to approximately three-times the width of the other teeth. Depending on the respective application, it may be advantageous to choose the width of the teeth 21 and the width of the tooth spaces 22 differently. It would furthermore be possible to provide a tooth space with a width that differs from that of the remaining tooth spaces 22 instead of a tooth 23 with a width that differs from that of the remaining teeth 21.

A rotation of the eccentric shaft 13 about the rotational axis 14 (see FIG. 1) also causes a rotation of the shaft encoder 20 coupled thereto in a rotationally rigid fashion such that its teeth 21, 23 and tooth spaces 22 pass and can be scanned by a sensor 25 that is arranged near the circumference of the shaft encoder 20 and realized, for example, in the form of an optical or inductive sensor.

The sensor signals generated while scanning the individual teeth 21, 23 and tooth spaces 22 of the rotating shaft encoder 20 are fed to an evaluation device 26 and processed and/or evaluated therein such that information on the current rotational position and/or rotational speed of the shaft encoder 20 is obtained.

For example, a defined rotational position of the shaft encoder 20 can be deduced from the sensor signals generated while scanning the wider tooth 23 passing the sensor 25. The current angular position of the shaft encoder 20 relative to the defined rotational position can then be determined by simply counting the respective additional teeth 21 or tooth spaces 21 that pass and are scanned by the sensor 25. It is furthermore possible to determine the rotational speed of the rotating shaft encoder 20 and, if applicable, to detect fluctuations of this rotational speed by intermittently or continuously counting the teeth 21, 23 and/or tooth spaces 22 passing the sensor 25.

The information derived in the evaluation device 26 is fed to a control unit 27 that can control or regulate the rotary piston machine in a predetermined fashion.

The control unit 27 controls a generator 28, by means of which the eccentric shaft 13 and the rotary piston 11 revolving about this eccentric shaft can be moved into a defined position, particularly at the time at which the rotary piston machine is started and/or after it was shut off.

Figure 3:
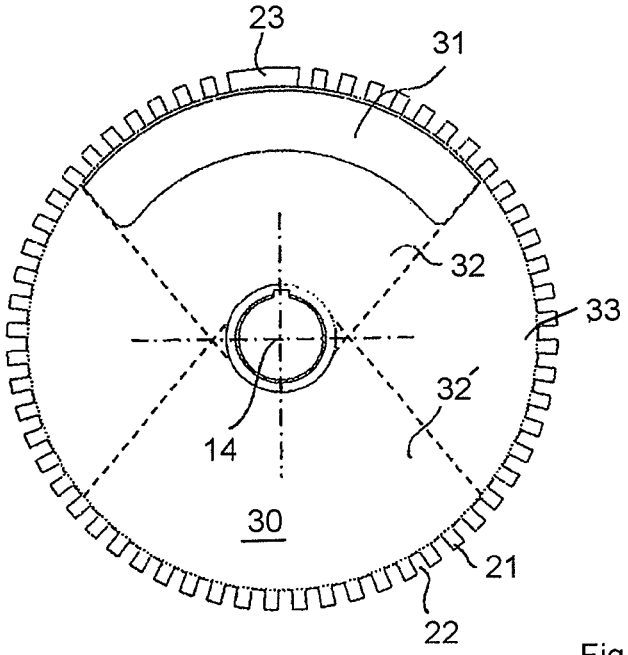
FIG. 3 shows an example of a shaft encoder with integrated imbalance.

FIG. 3 shows an example of a shaft encoder 30, to which the preceding explanations with reference to the exemplary shaft encoder 20 illustrated in FIG. 2 apply accordingly.

An additional mass 31 is provided in a region of the shaft encoder 30 and produces an imbalance during a rotation of the shaft encoder 30 about the rotational axis 14.

In the example shown, the mass 31 is arranged in a region of the shaft encoder 30 that extends on the outer edge of a segment of a circle 32 of the encoder disk 33. In this context, the encoder disk 33 should be interpreted as the disk-shaped inner region of the shaft encoder 30 without the teeth 21, 23 and tooth spaces 22 arranged in the circumferential region thereof.

The mass 31 may form an integral component of the shaft encoder 30, particularly of the encoder disk 33, wherein the shaft encoder and this mass are realized in one piece, for example, in the form of a single casting.

Due to the described arrangement of the mass 31, the resulting mass distribution is rotationally asymmetrical referred to the rotational axis 14 of the shaft encoder 30. A sector 32 of the encoder disk 33 consequently has a moment of inertia that is higher than the moment of inertia of a corresponding sector 32' that has the same sector surface and lies opposite of the sector 32 referred to the rotational axis 14.

Figure 4:
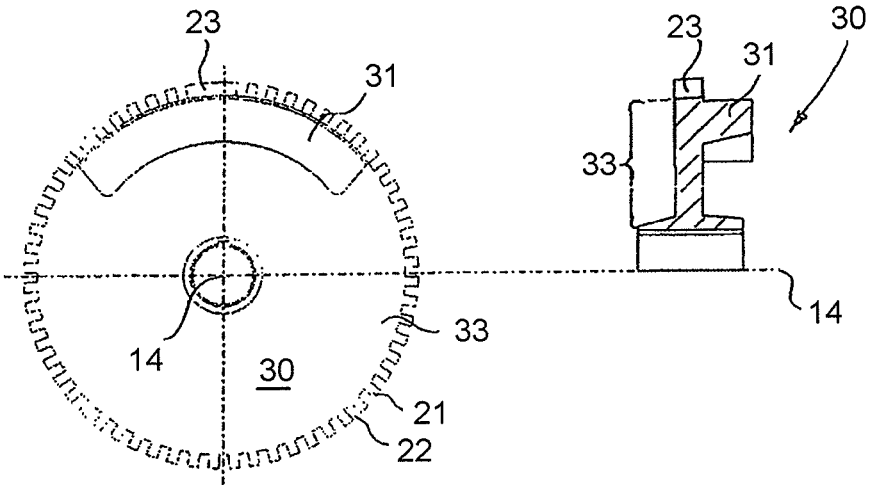
FIG. 4 shows the example according to FIG. 3 in the form of a front view and a side view.

FIG. 4 shows the shaft encoder 30 described with reference to FIG. 3 in the form of a front view (left portion of the figure), as well as in the form of a sectioned side view (right portion of the figure), in which the encoder disk 33, the wider tooth 23 arranged on the circumference of the encoder disk 33 and the additional mass 31 in the form of a projection are illustrated.

As an alternative or in addition to the projection shown, it is also possible to entirely or partially realize the additional mass 31 by providing a material with a mass density that is higher than the mass density of the encoder disk 33 in a corresponding region in or on the encoder disk 33. In the example shown, this would result in the projection being realized smaller or, if applicable, even eliminated in the region of the mass 31.

Figure 5:
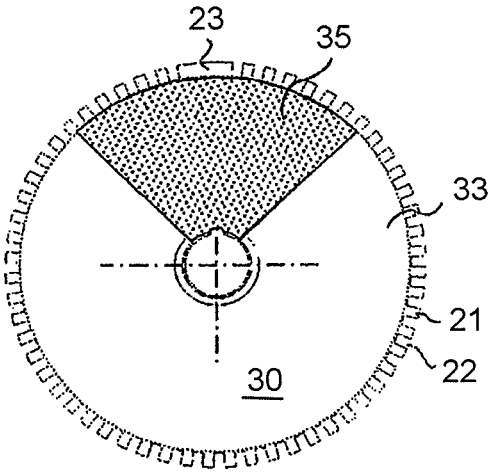
FIG. 5 shows an example of a shaft encoder with integrated imbalance.
Figure 6:
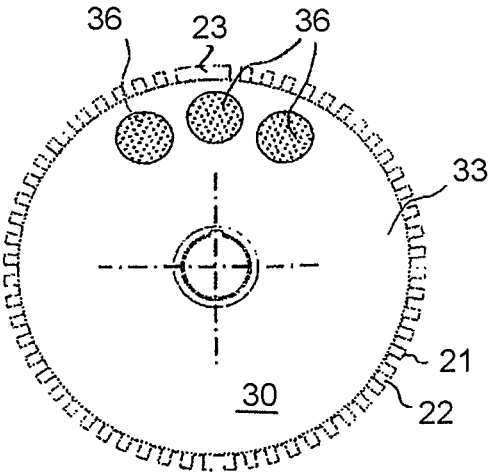
FIG. 6 shows another example of a shaft encoder with integrated imbalance.

FIGS. 5 and 6 show alternatives to the example of a shaft encoder 30 illustrated in FIGS. 3 and 4, in which a rotationally asymmetrical mass distribution for producing an imbalance is respectively realized with an additional mass 35 that is uniformly distributed over a sector of a circle of the encoder disk 33 and with additional mass elements 36 provided in the edge region of the encoder disk 33.

The imbalance during the rotation of the shaft encoder 30 about the rotational axis 14 may, in principle, be produced with a plurality of other embodiments. In this respect, it is decisive that the mass of the shaft encoder 30 is distributed about the rotational axis 14 of the shaft encoder 30 in such a way that only a rotation about the rotational axis 14 by an angle of 360°, but not a rotation by any other angle, causes the shaft encoder 30 to be mapped onto itself.

Figure 7:
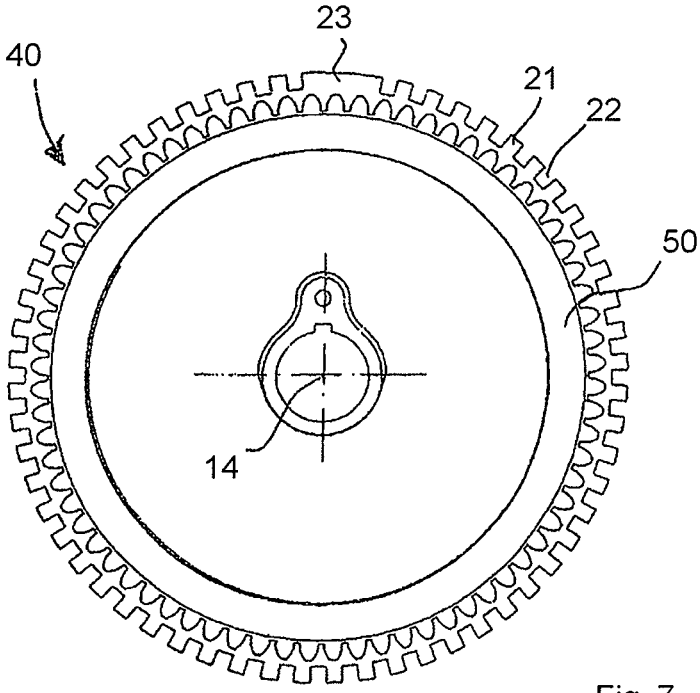
FIG. 7 shows an example of a shaft encoder with ring gear.

In contrast to the shaft encoder 20 illustrated in FIG. 2, FIG. 7 shows an example of a shaft encoder 40 with teeth 21, 23 and tooth spaces 22 that features an additional gear rim 50, into which a (not-shown) starter can engage in order to set the shaft encoder 40 and the eccentric shaft 13 coupled thereto (see FIG. 1) in rotation about the rotational axis 14. Due to this functional correlation, the gear rim 50 is also referred to as ring gear.

The function of the gear rim 50 may, in principle, also be realized with a differently designed structure that can cooperate with the starter, for example with one or more recesses or openings in the shaft encoder 40, into which a suitable element such as, e.g., a revolving pin of a corresponding starter can engage.

The shaft encoder 40 and the gear rim 50 may be realized in one piece, for example, by machining and/or forming a piece of metal or by producing a casting that comprises the shaft encoder 40 and the gear rim 50.

However, it would alternatively also be possible to respectively manufacture the shaft encoder 40 and the gear rim 50 separately, for example, by means of the above-described manufacturing techniques, and to subsequently connect these components, particularly by pressing the gear rim 50 onto the shaft encoder 40.

Due to the described integration of the gear rim 50 and the shaft encoder 40 into a single component that can be mounted on the eccentric shaft 13 (see FIG. 1), one installation step is eliminated during the assembly of the engine, namely the respective installation of an additional gear rim or shaft encoder on the eccentric shaft 13. Furthermore, this also simplifies the design of the engine and increases its compactness.

Figure 8:
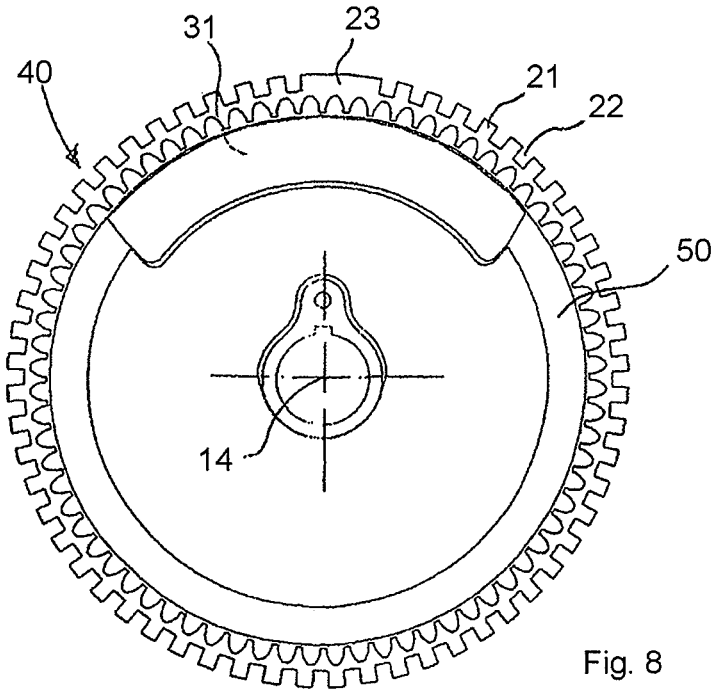
FIG. 8 shows an example of a shaft encoder with ring gear and integrated imbalance.

FIG. 8 shows an example of a shaft encoder that not only features a gear rim 50, but also a mass 31 for realizing a rotationally asymmetrical mass distribution and thusly producing an imbalance.

In this example, the advantageous effects of the shaft encoder 40 provided with a gear rim 50 (see FIG. 7) are combined with the advantages of a shaft encoder 30 with integrated imbalance. The preceding explanations with reference to the examples illustrated in FIGS. 3 to 6 accordingly apply to any potential design of the mass distribution of the shaft encoder 40.

Figure 9:
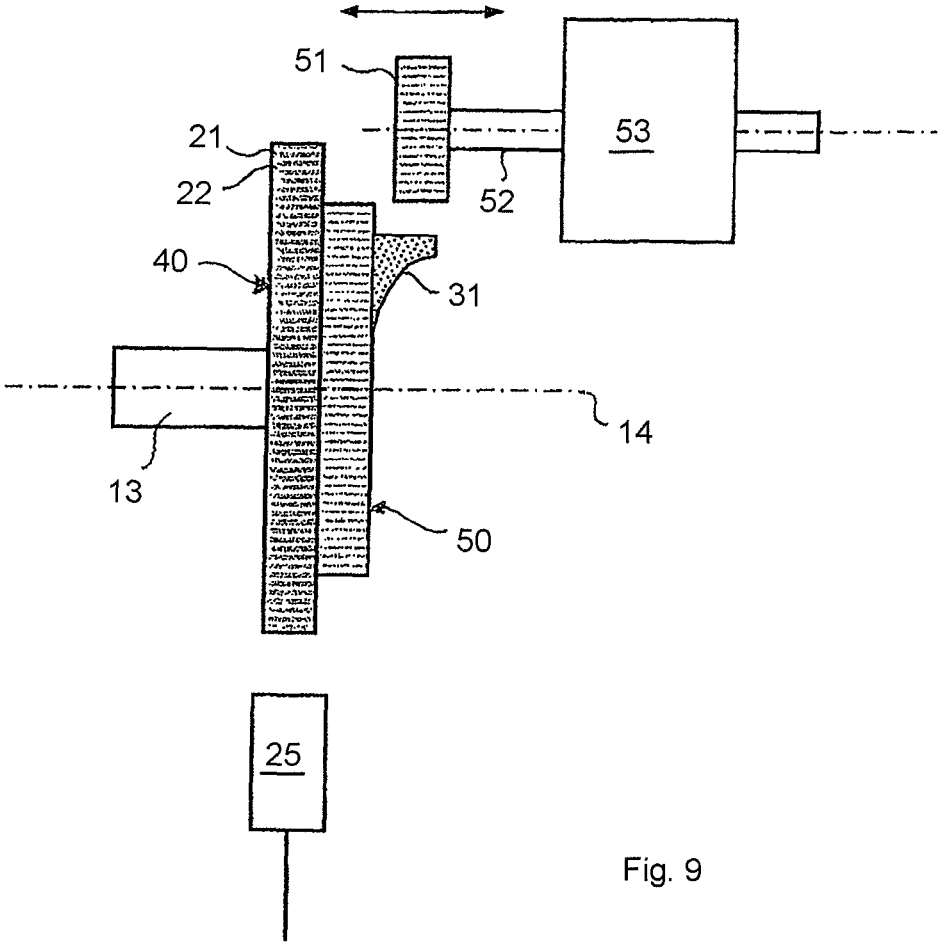
FIG. 9 shows an example of a shaft encoder with ring gear in connection with a starter for driving the shaft encoder.

FIG. 9 shows a schematic side view of an example of a shaft encoder 40 with ring gear 50 in connection with a starter for driving the shaft encoder 40.

The shaft encoder 40 provided with teeth 21, 23 and tooth spaces 22 is coupled to the eccentric shaft 13 of a rotary engine in a rotationally rigid fashion and also features a gear rim 50 that either forms an integral component of the shaft encoder 40 or is subsequently connected to the shaft encoder 40, for example, by means of pressing or welding.

During the rotation of the shaft encoder 40, the teeth 21, 23 and tooth spaces 22 pass a sensor 25 that scans these teeth and tooth spaces as already described above with reference to FIG. 2 such that information on the rotational position and/or rotational speed of the shaft can be derived.

In this example, the optionally provided mass 31 (see FIG. 8) is realized in the form of a projection on the gear rim 50, to which the preceding explanations with reference to the examples illustrated in FIGS. 3 and 4 apply accordingly.

The projection, the shaft encoder 40 and the gear rim 50 may also be realized in one piece, e.g. in the form of a casting, as already described in greater detail above.

It would alternatively also be possible to provide the projection on the shaft encoder 40, particularly on the encoder disk, and to realize these components in one piece. In this alternative, it may be required to provide the gear rim 50 with a correspondingly shaped recess, through which the projection arranged on the shaft encoder 40 can extend.

A starter pinion 51 is situated on a starter shaft 52 that is driven by an electric motor 53, wherein said starter pinion can engage into the gear rim 50 by displacing the starter shaft 52 in the direction of the gear rim, if applicable, together with the electric motor 53 and consequently set the gear rim, as well as the shaft encoder 40, in rotation. Due to this functional correlation, the device composed of the starter pinion 51, the starter shaft 52 and the electric motor 53 may also be referred to as an engaging starter.

According to at least one of the disclosed embodiments, an additional balancing weight is no longer required such that the design and the manufacture of the inventive rotary piston machine are significantly simplified.

While the above embodiment have been described with reference to the accompanying drawings, they are for illustrative purposes only and do not limit the invention. It is to be appreciated that those skilled in the art can change or modify the embodiments without departing from the scope and spirit of the invention.

What is claimed is:

1. A rotary piston machine, comprising:

a shaft; and a shaft encoder including a first structure, based on which the rotational speed and/or the rotational position of the shaft is configured to be determined by scanning the first structure with a sensor, wherein the shaft encoder has a rotationally asymmetrical mass distribution in order to produce an imbalance, wherein the shaft encoder comprises a circular encoder disk, on which the first structure is arranged, and wherein the rotationally asymmetrical mass distribution excludes the first structure and is formed within a circumference of the circular encoder disk, and wherein the first structure is arranged on the outer circumference of the encoder disk.

2. The rotary piston machine according to claim 1, wherein the mass distribution of the shaft encoder, as well as the resulting imbalance, is realized so as to reduce or compensate an imbalance of the shaft.

3. The rotary piston machine according to claim 1, wherein the shaft encoder, the first structure and/or a second structure are realized in one piece.

4. The rotary piston machine according to claim 1, wherein the shaft encoder, the first structure and/or a second structure are realized in the form of a casting.

5. The rotary piston machine according to claim 1, further comprising a second structure that is pressed onto the shaft encoder.

6. The rotary piston machine according to claim 1, wherein the shaft encoder is connected to the shaft in a rotationally rigid fashion.

7. The rotary piston machine according to claim 1, wherein the shaft is an eccentric shaft.

8. The rotary piston machine according to claim 1, further comprising:

a sensor configured to scan the first structure of the shaft encoder; and an evaluation device configured to derive the rotational speed and/or the rotational position of the shaft based on the scanned first structure of the shaft encoder.

9. The rotary piston machine according to claim 1, wherein a portion of the circular encoder disk is formed of a material with a mass density that is higher than the mass density of the remaining portion of the circular encoder disk.

10. The rotary piston machine according to claim 1, wherein at least one mass element is integrated into the circular encoder disk.

11. The rotary piston machine according to claim 1, wherein the first structure comprises at least one tooth.

12. The rotary piston machine according to claim 1, wherein the encoder disk comprises at least one first sector that has a higher moment of inertia than a second sector of the encoder disk that corresponds to the first sector and lies opposite thereof.

13. The rotary piston machine according to claim 12, wherein the encoder disk has in at least one region of the first sector a greater thickness and/or mass density than in the corresponding region of the second sector.

14. The rotary piston machine according to claim 13, wherein the region of the first sector extends in the circumferential direction of the encoder disk.

15. The rotary piston machine according to claim 1, wherein the shaft encoder comprises a second structure, and wherein a starter is configured to cooperate with this second structure so as to set the shaft encoder in rotation.

16. The rotary piston machine according to claim 15, wherein the second structure of the shaft encoder comprises a gear rim configured to be set in rotation by a gearwheel of the starter.

17. The rotary piston machine according to claim 15, further comprising a starter configured to engage into the second structure of the shaft encoder so as to set the shaft encoder in rotation.

18. The rotary piston machine according to claim 1, wherein the rotationally asymmetrical mass distribution comprises at least one mass element axially extending from the circular encoder disk.

19. The rotary piston machine according to claim 18, wherein the at least one mass element is an integral component of the circular encoder disk.

20. The rotary piston machine according to claim 18, wherein the at least one mass element is attached to the circular encoder disk.

21. A rotary piston machine, comprising:

a shaft; and a shaft encoder including a first structure, based on which rotational speed and/or rotational position of the shaft is configured to be determined by scanning the first structure with a sensor, wherein the shaft encoder has a rotationally asymmetrical mass distribution in order to produce an imbalance, wherein the shaft encoder comprises an encoder disk, on which the first structure is arranged, wherein the encoder disk has a rotationally asymmetrical mass distribution, wherein the encoder disk has a circular body, wherein the encoder disk comprises a projection formed within the circular body and extending in a direction perpendicular to the radial direction of the circular body of the encoder disk, and wherein the first structure is arranged on the outer circumference of the encoder disk.

* * * * *